United States Patent [19]

Wang

[11] Patent Number: 4,539,941

[45] Date of Patent: Sep. 10, 1985

[54] OSCILLATING PISTON ENGINE

[76] Inventor: Chin-Yen Wang, P.O. Box 10160, Taipei, Taiwan

[21] Appl. No.: 566,209

[22] Filed: Dec. 28, 1983

[51] Int. Cl.[3] ..... F02B 53/06

[52] U.S. Cl. ..... 123/18 R

[58] Field of Search ..... 91/339; 123/18 R, 18 A; 417/481

[56] References Cited

U.S. PATENT DOCUMENTS 3,408,991 11/1968 Davis ..... 123/18 R 3,948,226 4/1976 Green et al. ..... 123/18 R

FOREIGN PATENT DOCUMENTS 2110672 9/1972 Fed. Rep. of Germany .... 123/18 R

*Primary Examiner*—Michael Koczo

[57] ABSTRACT

An oscillating piston engine is formed with a wing-shaped piston having two symmetric extensions oscillating within two kidney-like cylinders in the cylinder body so that the power can be directly and continuously transmitted outwards by a power transmission shaft having a pair of semi-circle sector bevel gears alternatively engaged with a bevel gear formed under the piston shaft.

6 Claims, 11 Drawing Figures

OSCILLATING PISTON ENGINE

BACKGROUND OF THE INVENTION

Conventional four-stroke internal combustion engine will lose great inertia force due to reciprocative motion of piston moving between upper and lower dead points within the cylinder and may even affect the force balance of the engine. The force exerted during combustion and explosion in an engine may be reduced through the transmission from piston to crank shaft due to frictional force loss so that the engine efficiency will be decreased.

The present inventor has found the defects of conventional four-stroke engine and invented the present oscillating piston engine.

SUMMARY OF THE INVENTION

The object of the present invention is to provide an oscillating piston engine wherein a wing-shaped piston is provided in a cylinder body for oscillating motion and a pair of semi-circle sector bevel gears are formed on a transmission shaft to alternatively engage with a bevel gear formed under an intersecting spline shaft of the piston so that the oscillating motion of the piston will be converted into rotary motion of the transmission shaft for direct and continuous output of power.

Another object of the present invention is to provide an oscillating piston engine wherein a wing-shaped spring plate is provided under the piston shaft to auxiliarily rebound the piston shaft to facilitate the oscillating motion of the piston and to increase the output power of the engine.

DETAILED DESCRIPTION

Figure 1:
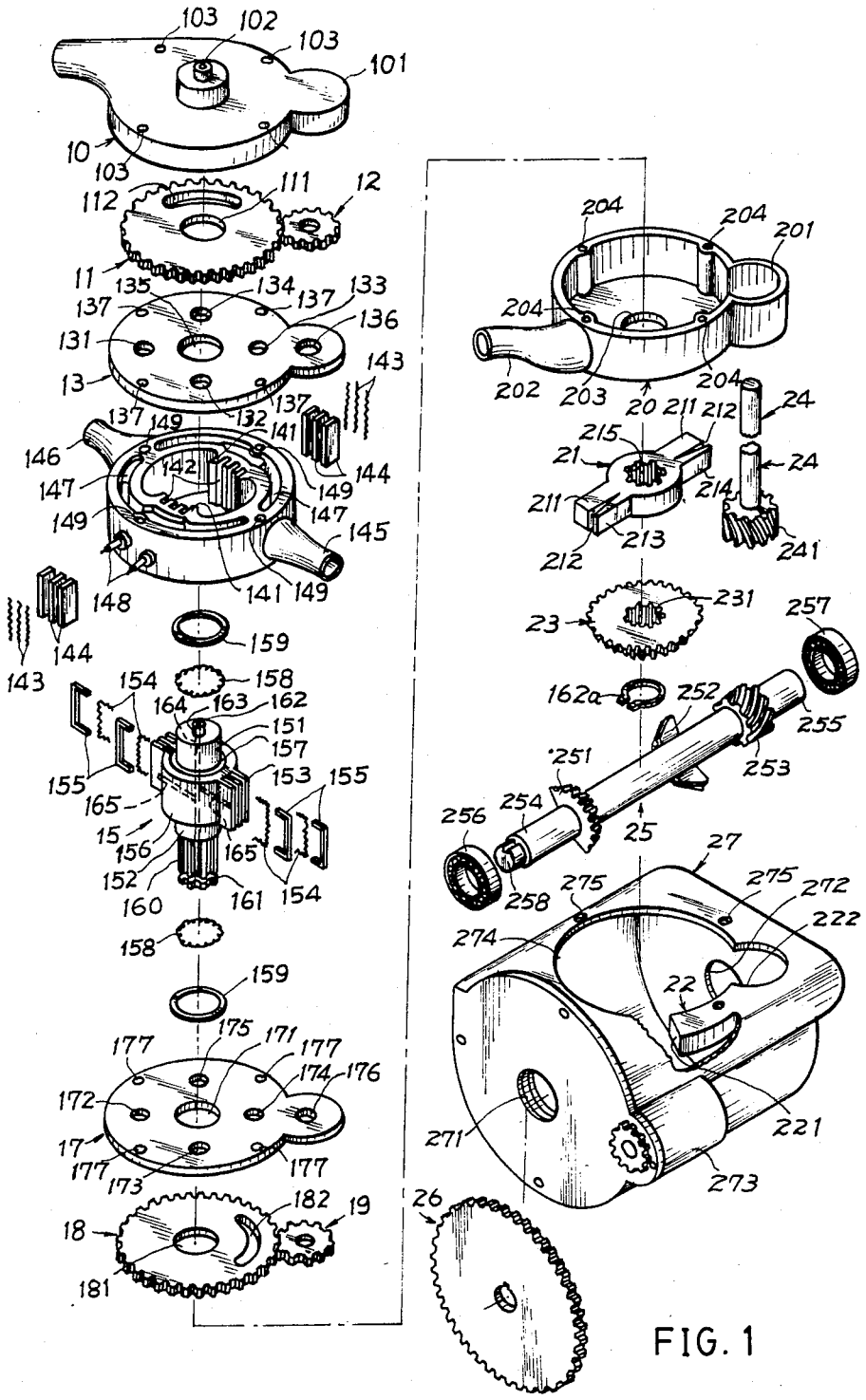
FIG. 1 is an illustration showing the dismantled parts of the present invention.
Figure 2:
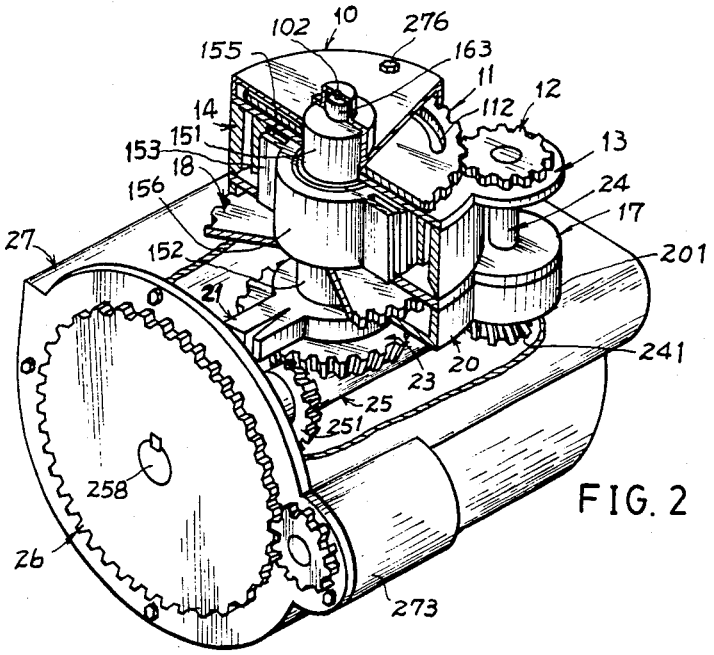
FIG. 2 is a partial cut-away drawing of the present invention.

As shown in FIGS. 1 and 2, the present invention comprises: a gas-exhaust end cover 10, an exhaust disc valve 11, an exhaust gear 12, an upper cylinder cover 13, a cylinder body 14, a wing-shaped piston 15, a lower cylinder cover 17, a gas-inlet disc valve 18, an inlet gear 19, an inlet end cover 20, a wing-shaped spring plate 21, a rebound block 22, a bevel gear 23, a gas in-and-out control shaft 24, a power transmission shaft 25, a fly wheel 26 and a casing 27.

Gas-exhaust end cover 10 is integratedly formed with a gear cover 101 for storing exhaust gear 12. An injection hole 102 for cooling and handling lube oil is centrally formed on end cover 10. Exhaust disc valve 11 is formed with a central hole 111 and an exhaust arc hole 112. The upper shaft portion 151 of wing-shaped piston 15 is rotatably inserted into central hole 111 of exhaust disc valve 11 which is smoothly rotated under gas-tight condition above the upper cover 13 and controlled by gear 12 as driven by shaft 24. Four exhaust holes 131, 132, 133 and 134 are formed on upper cover 13, each separated in equal radian. A central bearing 135 is formed for passing upper shaft portion 151 of wing-shaped piston 15 and another bearing 136 is provided for passing shaft 24.

Two internal extensions 141 are symmetrically formed inside cylinder body 14. Each internal extension 141 is formed with several expansion-plate grooves 142 each inserted with expansion plate 144 and corrugated spring 143 therein for securing the gas tightness. A water jacket 147 is formed on inside wall of cylinder body 14 to dispose outside the two kidney-like cylinders 141*a*. A water inlet 145 and water outlet 146 are respectively formed on cylinder body 14 to communicate with water jacket 147. Several spark plugs 148 are suitably formed on cylinder body 14 to respectively ignite the combustion chamber aside the internal extension 141. Wing-shaped piston 15 is symmetrically formed with two extensions 153*a* each formed with several expansion-plate grooves 153 for inserting expansion plates 155 and springs 154 for operative gas tightness. Piston 15 comprises a piston shaft 156 which extends upwards to form an upper shaft portion 151 and extends downwards to form a lower shaft portion 152. Upper shaft portion 151 further extends an end shaft 163 which is centrally formed with an oil injection hole 162 to communicate with oil hole 102. A vertical oil passage 164 is centrally formed within shaft portion 151 and shaft 156 to intersect several oil passages 165 leading to expansion-plate grooves 153 for cooling and lubricating piston. Two spring rings 158 and expansion rings 159 are respectively formed on the upper and lower grooves 157 of piston shaft 156 for smooth and gas-tight rotation of piston. The lower shaft portion 152 extends downward a spline shaft 160 which is lowerly formed with a c-shape retainer ring 162*a*.

Lower cylinder cover 17 is centrally formed with a bearing 171 for passing lower shaft portion 152 of piston 15. Four gas inlet holes 172, 173, 174 and 175 are formed on cover 17. A bearing 176 is formed for rotatably mounting gas in-and-out control shaft 24. Gas-inlet disc valve 18 is formed with a central hole 181 and a gas inlet arc hole 182. An inlet gear 19 is engaged with inlet disc valve 18 and is driven by shaft 24. The gear cover 201 is made integrally with inlet end cover 20. A gas inlet 202 is formed on end cover to connect with a carburetor. A bearing 203 is formed to rotatably mount the lower shaft portion 152 of piston 15.

Wing-shaped spring plate 21 extends symmetrically on both sides two spring plates 211 each cut with a V-shape recess 212. Two impacting surfaces 213,214 are respectively formed on two plates 211 to be correspondingly rebounded by surfaces 221, 222 on an arcuated rebound block 22 formed on casing 27. Spring plate 21 is centrally formed with a shaft hole 215 for engaging spline shaft 160. Bevel gear 23 is also formed with a shaft hole 231 to engage with spline shaft 160 and retained by retainer ring 162*a*.

Figure 4:
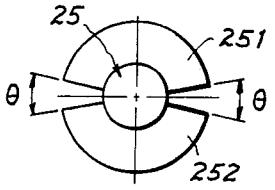
FIG. 4 is a side-view drawing showing the distribution of the sector bevel gears of the present invention.

A pair of sector bevel gears 251, 252 are separatedly formed on power transmission shaft 25 to alternatively engage with two opposite sides of the bevel gear 23 under piston 15 when oscillating the piston 15 and shaft 160. Each sector bevel gear 251 or 252 is formed as a semi-circle on shaft 25. But the two sector gears 251, 252 are not overlapped with each other as projective side-view shown in FIG. 4. Each sector gear is formed with two open cutting ends, of which one cutting end of one sector bevel gear is separated in an acute angle $\sigma$ from another cutting end of another sector bevel gear so as to make alternative engagement of either sector bevel gear 251 or 252 with the bevel gear 23 formed on shaft 160.

A worm gear 253 is formed on the end of power transmission shaft 25 to engaged with the gear 241 of gas in-and-out control shaft 24 to control the rotation of inlet disc valve 18 or exhausted disc valve 11. Two bearings 256, 257 are respectively provided on sockets 271, 272 for transmission shaft 25. The connector 258 of shaft 25 extends outwards for connecting a fly wheel 26 which is engaged with a gear of starting motor 273. The casing opening 274 is sealed with inlet end cover 17. Several fixing bolts 276 are provided to pass through holes 103 on exhausted end cover 10, holes 137 on upper cover 13, holes 149 on cylinder body 14, holes 177 on lower cover 17 and holes 204 on inlet end cover 20 and finally fixed onto holes 275 on casing 27 to assemble the present invention.

The cylinder body 14, as bottom-view shown in FIGS. 3A–D, comprises two kidney-like cylinders 141*a* both separated diagonally. Each cylinder is formed with two combustion chambers A, B or C, D, each chamber communicated with the spark plug 148 and gas passage from carburetor.

From the projective bottom view of this invention as shown in FIGS. 3A–3D, the upper four exhaust holes 131, 132, 133 and 134 are projectively overlapping on the lower four gas-inlet holes 172, 173, 174 and 175. Each hole of either the upper four holes or the lower four holes is positioned at each corner between either diagonal line $l_1$ or $l_2$ and a circular line $l_3$ along the inside wall of cylinders 141*a* as projective bottom view as shown in FIGS. 3A–3D. Such a diagonal line $l_1$, $l_2$ is a hypothetic line centrally formed on the two opposite extensions 153*a* of piston 15 when moved to its dead point.

The two kidney-like cylinders 141*a* are diagonally formed on two opposite quadrants inside the cylinder body 14, each cylinder having an arc length larger than one-fourth length of the hypothetic circular line $l_3$. The two internal extensions 141 of cylinder body 14 are respectively formed on the other two opposite quadrants as FIG. 3 shown. The exhaust arc hole 112 is positioned in a quadrant projectively neighbored to the lower gas-inlet arc hole 182 positioned in another neighbor quadrant so as to allow only one upper exhaust hole on upper cover 13 communicated with the exhaust arc hole 112 on exhaust valve 11 and to allow only one lower gas-inlet hole on lower cover 17 communicated with the gas-inlet arc hole 182 on inlet disc valve 18 during oscillating operation of piston 15.

Figure 3A:
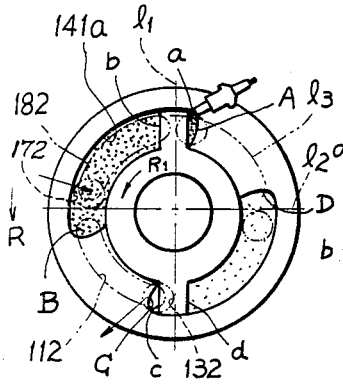
FIG. 3A shows the first step of working principle of the present invention from its projective bottom view.

When using the engine of this invention, the operating cycles are described as follows with reference to FIGS. 3A–3D:

1. In FIG. 3A, the chamber A is compressed for ignition, the chamber B finished for gas induction, the chamber C exhausted the waste gas and chamber D filled with waste gas after last combustion. Meanwhile, the inlet gas enters chamber B through lower arc hole 182, lower inlet hole and the waste gas exhausts from chamber C to discharge through upper exhaust hole and arc hole 112.

The ignition and explosion of chamber A will push the face a of piston extension 153*a* in direction R1 to rotate the shaft 160 and bevel gear 23 in 90 degrees and, in turn, to rotate the shaft 25 for power output and rotate the vertical shaft 24, gear 19 and inlet disc valve 18 in 90 degrees as direction R shown in the figure.

Figure 3B:
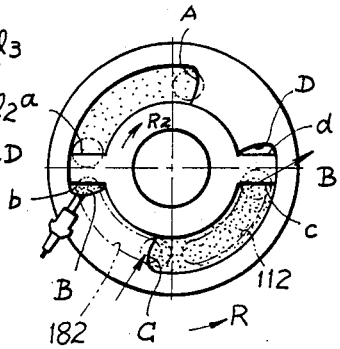
FIG. 3B shows the second step when working the present invention following FIG. 3A.

2. In FIG. 3B, chamber B compresses for ignition, chamber A expands the waste combustion gas, chamber C finishes gas induction and chamber D exhausts the waste gas of the last combustion. The ignition and explosion in chamber B will push face 6 of piston 15 in a counter rotation R2 and also rotate the two valves 18, 13 for another quadrant as moving in direction R.

Figure 3C:
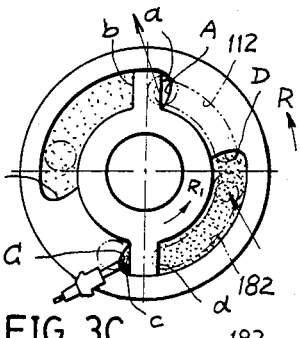
FIG. 3C shows the third step when working the present invention following FIG. 3B.

3. In FIG. 3*c*, chamber A exhausts the gas, chamber C compresses for the next ignition and chamber D finishes the gas induction. The ignition in chamber C will drive the piston in direction R1 and also rotate (R) the two valves 18, 13 for still another quadrant.

Figure 3D:
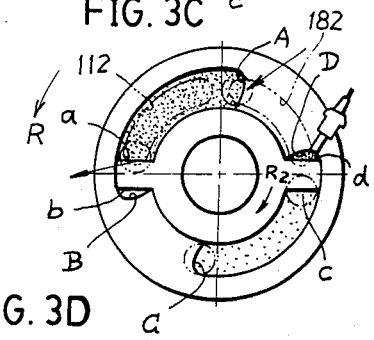
FIG. 3D shows the fourth step when working the present invention following FIG. 3C.
Figure 5A:
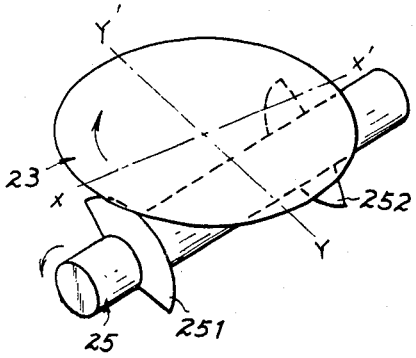
FIG. 5A shows the working principle of power transmission of the present invention.
Figure 5B:
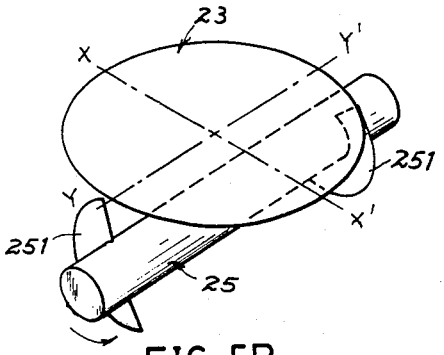
FIG. 5B shows the continued step of power transmission of the present invention following FIG. 5A.
Figure 6:
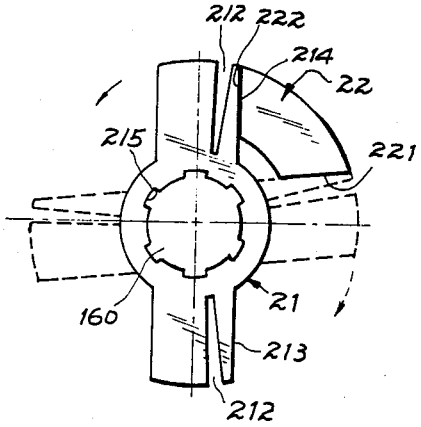
FIG. 6 is an illustration showing the operation of the wing-shaped spring plate of the present invention.
Figure 5C:
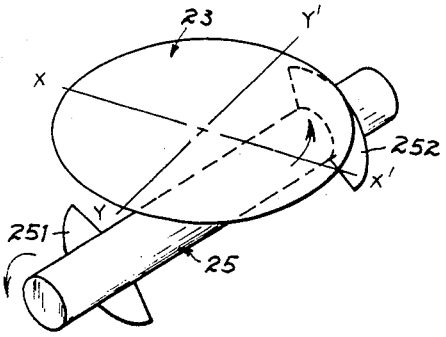
FIG. 5C shows another oscillating step of the power transmission following FIG. 5B.

4. In FIG. 3D, chamber A aspirates the intake gas, chamber B exhausts the gas, chamber C expands the combustion gas and chamber D compresses for next ignition. The ignition in chamber D will drive the face d of piston 15 to rotate in a counter direction R2. The rotation in direction R1 and the counter rotation in another direction R2 form an oscillating motion of piston 15. During each rotation R1 (FIGS. 5A and B), the bevel gear 23 will engage with sector bevel gear 251 to drive the power transmission shaft 25 and fly wheel 26. During the counter rotation R2 as shown in FIG. 5*c*, the bevel gear 23 will engage with another sector gear 252 to drive shaft 25 in the same rotary direction. By the way, the oscillating motion of piston will be converted into continuous rotary motion of the shaft 25. At the same time of oscillation of piston 15, the wing-shaped spring plate 21 will oscillatingly impact on either end of rebound block 22 as FIG. 6 shown to exert the resilient force to auxiliarily increase the output power from the piston.

The present invention has the following advantages superior to coventional engines:

1. The wing-shaped piston is reciprocatively operated and continuously transmitted power outwards through the two sector bevel gears formed on transmission shaft without zero-torque.

2. The wing-shaped spring plate auxialiarily increases the output power of the present invention.

3. Round construction of the present invention may reduce the mechanical transmission resistance and may increase the compression ratio and revolution speeds so as to save energy.

4. Round construction of the present invention may mininize the parts, volume and weight so as to reduce the maintenance problems and production cost.

5. The round rotation of the present invention may enhance the engine balance and stability during operation.

I claim:

1. An oscillating piston engine comprising a gas-exhaust end cover having an oil injection hole, an exhaust disc valve mounted atop on an upper cylinder cover with gas tightness and driven by an exhaust gear formed atop on a gas in-and-out control shaft which is lowerly engaged with an intersecting power transmission shaft, and said upper cylinder cover formed with four gas exhaust holes; each separated in equal radians;

a cylinder body having two kidney-like cylinders formed diagonally inside said cylinder body, each kidney-like cylinder having two combustion chambers provided with spark plugs and gas passages from a carburetor, and having two symmetrical internal extensions each formed with several expansion-plate grooves for inserting expansion plates and springs therein for gas tightness;

a wing-shaped piston symmetrically formed with two extensions on both sides each inserted with expansion plates and springs into grooves formed thereon;

a lower cylinder cover formed with four gas-inlet holes thereon;

a gas-inlet disc valve mounted under said lower cylinder cover and engaged with an inlet gear driven by said gas in-and-out control shaft;

an inlet end cover formed under said inlet disc valve and formed with a gas inlet to connect to a carburetor;

a wing-shaped spring plate engaged with a spline shaft formed under said piston and oscillatingly impacting on both sides of an arcuated rebound block formed on a casing;

a bevel gear formed on the spline shaft of said piston and alternatively engaged with a pair of sector bevel gears separately formed on a power transmission shaft;

a fly wheel connected to said power transmission shaft and engaged with a starting motor; and a casing covering the rotary engine, each of said pair of sector bevel gears formed as a semi-circle and formed with two open cutting ends of which one cutting end of one sector gear is separated from another cutting end of another sector gear with an acute angle when projectively viewed along said transmission shaft, whereby the rotation of said piston in one direction will drive said transmission shaft for rotary motion as said bevel gear under said piston engages with one sector bevel gear on said transmission shaft, and counter rotation of said piston will still drive said transmission shaft in the same rotary motion as said bevel gear under said piston engages with another sector bevel gear on said transmission shaft so as to convert the oscillating motion of said piston into a continuous rotary motion of said transmission shaft.

2. An oscillating piston engine according to claim 1, wherein said wing-shaped piston comprises a piston shaft extending upwardly and having an upper shaft portion rotatably mounted in said upper cylinder cover, said exhaust disc valve and said exhaust end cover; and extending downwardly and having a lower shaft portion which passes through said lower cylinder cover, said inlet disc valve and inlet end cover and is formed with a spline shaft for engaging with said wing-shaped spring plate and said bevel gear thereunder.

3. An oscillating piston engine according to claim 1, wherein said wing-shaped spring plate is formed with two symmetrical spring plates each cut with a V-shape recess and oscillatingly impacting on a rebound block to increase output power of said transmission shaft.

4. An oscillating piston engine according to claim 1, wherein from said piston extends an upper shaft portion which further extends an end shaft centrally formed with an oil injection hole to communicate with an oil injection hole formed on said gas-exhaust end cover, said oil injection hole leading through a vertical oil passage formed within said piston to connect several oil passages intersecting said vertical oil passage and finally communicated with said expansion-plate grooves for cooling and lubricating said piston.

5. An engine according to claim 1, wherein said power transmission shaft is formed with a worm gear to engage with a gear formed on said gas in-and-out control shaft.

6. An engine according to claim 1, wherein said cylinder body is formed with a water jacket inside said cylinder body which is connected with a water inlet and a water outlet to communicate with said water jacket.

* * * * *